US008316960B2

(12) United States Patent
Robson

(10) Patent No.: US 8,316,960 B2
(45) Date of Patent: Nov. 27, 2012

(54) HAMMER DEVICE

(75) Inventor: Angus Peter Robson, Matamata (NZ)

(73) Assignee: Terminator IP II SA, Luxembourg (LU)

( * ) Notice: Subject to any disclaimer, the term of this patent is extended or adjusted under 35 U.S.C. 154(b) by 0 days.

(21) Appl. No.: 10/532,572

(22) PCT Filed: Oct. 21, 2003

(86) PCT No.: PCT/NZ03/00235

§ 371 (c)(1),
(2), (4) Date: Feb. 6, 2006

(87) PCT Pub. No.: WO2004/035939

PCT Pub. Date: Apr. 29, 2004

(65) Prior Publication Data

US 2006/0201292 A1 Sep. 14, 2006

(30) Foreign Application Priority Data

Oct. 21, 2002 (NZ) ..... 522157

(51) Int. Cl.
*E21B 1/02* (2006.01)

(52) U.S. Cl. ..... 173/185; 173/184; 173/187

(58) Field of Classification Search ..... 173/25, 173/91, 90, 128, 132, 185, 187, 184; 30/277; 81/27; 299/37.5, 100, 101; 175/135, 122, 175/162, 293, 296

See application file for complete search history.

(56) References Cited

U.S. PATENT DOCUMENTS 133,478 A * 11/1872 Pierce ..... 173/30
1,570,650 A * 1/1926 Thomson ..... 30/168
1,731,576 A * 10/1929 Jackson ..... 173/51
3,205,952 A * 9/1965 Sicotte ..... 173/124
3,342,531 A * 9/1967 Krekeler ..... 299/107
3,566,668 A * 3/1971 Browning ..... 73/12.13
3,568,657 A * 3/1971 Gue ..... 125/40
3,807,802 A * 4/1974 Betters ..... 299/37.3
4,759,412 A * 7/1988 Brazell, II ..... 173/185
4,813,494 A * 3/1989 Beard et al. ..... 173/91
4,838,363 A * 6/1989 MacOnochie ..... 173/210
4,844,661 A 7/1989 Martin et al.
4,848,197 A * 7/1989 Kikel ..... 81/440
5,012,873 A * 5/1991 Kennedy et al. ..... 173/185
5,248,001 A 9/1993 Moseley
5,363,835 A * 11/1994 Robson ..... 125/40
5,490,740 A * 2/1996 Johnson ..... 299/37.4
5,607,022 A * 3/1997 Walker et al. ..... 173/10
5,699,864 A * 12/1997 Dvorak et al. ..... 173/91
5,803,550 A * 9/1998 Watson et al. ..... 299/13
5,810,102 A * 9/1998 Stewart ..... 175/401
5,926,885 A * 7/1999 Williams ..... 7/165
6,003,619 A * 12/1999 Lange ..... 173/184
6,196,088 B1 3/2001 Youngren
6,257,673 B1 * 7/2001 Markham et al. ..... 299/100
6,439,317 B1 * 8/2002 Minotti et al. ..... 173/89
7,611,209 B2 * 11/2009 Fader ..... 299/104

* cited by examiner

*Primary Examiner* — Lindsay Low
*Assistant Examiner* — Nathaniel Chukwurah
(74) *Attorney, Agent, or Firm* — Stephen M. De Klerk

(57) ABSTRACT

The present invention relates to a drop hammer assembly including a drop hammer configured with at least two end conditions, characterized in that the position of the end conditions can be reversed when required. Also claimed is a method of reversing the drop hammer with respect to the drop hammer housing.

13 Claims, 3 Drawing Sheets

HAMMER DEVICE

CROSS-REFERENCE TO OTHER APPLICATIONS

This is a National Phase of International Application No. PCT/NZ2003/000235, filed on Oct. 21, 2003, which claims priority from New Zealand Patent Application No. 522157, filed on Oct. 21, 2002.

1. Technical Field

This invention relates to an improved device.

In particular it relates to an improvement to a device that is used for the breaking or weakening of material.

2. Background Art

It is common practice in the construction or demolition industry to use hydraulic hammers in order to break up concrete, rock, hard ground, asphalt or unwanted structures for removal or further construction.

A large proportion of the material to be broken up consists of either concrete or asphalt. These materials have very different characteristic and therefore require different type of machinery or tool bits to break them up. Concrete is a very brittle material and can therefore be smashed by impaction. Asphalt is a ductile or 'plastic' material that tends to absorb a lot of the energy applied through impaction. Accordingly, asphalt or similar materials need to be fractured. A finer blade will effectively slice, puncture or crack the material, therefore allowing demolition to be completed by cutting rather than hammering.

Where asphalt is laid over concrete, as with many north American roadways, two types of hammer configurations can be required to complete the job, depending on the thickness of the asphalt. This double layer can therefore mean the need for more than one demolition machine on a job, doubling the cost of demolition and creating down time for the concrete breaker while the asphalt breaker gets started and exposes the concrete.

Furthermore, ground that has been frozen by permafrost, for example in central Europe, can also have a more ductile or plastic nature. A blunt ended hammer will apply a force that will often be absorbed by the ground, resulting in either a punched hole and no fracture, or the ground will just bounce back due to the springiness of the peat beneath it. A finer blade tip is required to fracture the material. Again, either further machines are required, or the industry is delayed over the winter months. Additionally, the colder the conditions, the greater the likelihood of damage to the machinery due to temperature gradients across the hammer leading to thermal shock and resultant fracture.

The breaking up of ground that is frozen due to permafrost with current technology has proved to be virtually impossible and as such construction is limited to the warmer months that in some cases can be as short as ten to twelve weeks.

It would be an advantage to extend that construction time, even by a few weeks either side of the warmer months.

A typical drop hammer, being one type of demolition hammer device, consists of a heavy plug or column that is raised and then released. Gravity propels the plug or column towards the ground and the type of impact with the ground is determined by the shape of the face of the plug or column that connects with the ground.

It would be an advantage to be able to easily vary the nature of fracture beneath the drop hammer so as to enable a single machine to operate in various conditions with different types of materials. However, any ability to vary the nature of fracture must be combined with the usual durability and overall strength required by the industry. It would be a limitation to produce a system that could be varied, but required high maintenance or a large period of downtime to implement.

All references, including any patents or patent applications cited in this specification A prior art breaker of the applicant's design is used in demolition work connected to an articulated arm of an excavator, skid steer or like machine. The breaker has a housing in which a drop hammer is received. A drive mechanism enclosed in the housing includes a loop of chain having a dog fixed thereto and a motor for rotating the chain, the dog abutting a projection on the hammer to raise the hammer, moving it away from an opening end of the housing. The hammer is then dropped to extend from opening end of the housing to impact the working surface. Although this breaker performs satisfactorily, a number of tool changes on the excavator (e.g. swapping a concrete breaker with an asphalt breaker) are required during a demolition operation since different hammers are required depending upon the material to be broken.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a hammer assembly including:

a housing;

a hammer received in the housing and a drive mechanism for reciprocating the hammer, wherein the hammer is substantially elongated with first and second tool ends located at opposing longitudinal ends of the hammer, each tool end capable of extending through a lower opening end in the housing to strike the working surface, the hammer assembly characterised in that the hammer is capable of being removed from the housing, reversed and replaced in the housing, enabling either of the first and second tool ends orientated to extend through the lower opening end in the housing to be interchanged.

According to another aspect of the present invention the hammer includes at least one protrusion on each of two opposing hammer faces adapted for engagement with the drive mechanism.

According to a further aspect of the present invention the hammer includes a protrusion thereon and the drive mechanism includes a loop of chain having at least one dog fixed thereto and a motor for rotating the chain, the dog abutting the protrusion to lift the hammer away from the opening end of the housing.

Preferably the housing is configured for attachment to an articulated arm of an excavator or other machine and the drive mechanism is enclosed within the housing.

In one embodiment, the hammer assembly further includes a cushion fixed near the opening end of the housing for engaging the protrusion.

In one preferred embodiment, the hammer is adapted to drop under gravity toward the opening end of the housing before striking the working surface.

In one alternative embodiment, the drive mechanism includes means for engaging and driving the hammer from the housing to strike the working surface.

In a further preferred embodiment, the hammer is propelled to strike the working surface by gravity and by engagement with the drive mechanism.

In one embodiment the hammer is cylindrical and multi-faceted.

According to one embodiment, the opposing hammer tool ends are non-identical and may be formed in a variety of configurations including a substantially flat surface, a blade, a substantially convex surface, substantially concave surface, or a spike.

Preferably, the drive mechanism is configured to lift the hammer includes at least two sprockets, and at least one dog and a chain, wherein a dog is attached to a chain and is adapted to engage the protrusion.

Preferably said chain is adapted to be rotated around said at least two sprockets.

In one embodiment, said sprockets, dog and chain are aligned substantially parallel to the hammer.

In an alternative embodiment, said sprockets, dog and chain are aligned substantially perpendicular to the hammer.

According to a yet further aspect of the present invention the hammer assembly further includes a connecting apparatus between the hammer and the hammer housing, and said connecting apparatus is capable of elastic deformation, and is detachable.

According to one aspect of the present invention there is provided a method of interchanging the tool ends on a hammer assembly, said method characterised by the steps of:

withdrawing the hammer from the housing, reversing the orientation of the hammer, and reinserting the hammer into the housing.

In preferred embodiments, the hammer is an elongated shaft of either cylindrical or multi-faceted proportions that is able to be lifted in a substantially vertical direction prior to being released.

In some embodiments, gravity is used to provide the propulsion required to impart a force to the ground beneath the hammer.

In other embodiments, the hammer is also able to function in a direction away from the vertical, allowing it to break material that is above ground level. The introduction of an accelerating means allows the assembly to function without such a large reliance on gravity to propel the hammer toward the ground or material to be broken.

It should be appreciated that it is an advantage of the present invention that the hammer is directly impacting the material desired to be broken, it is not striking an intermediate tool. This means that the system as a whole is simple and there are less moving parts to wear and fail over time. Each face can be reinforced, or built up after wear, and the hammers themselves can be replaced.

In some embodiments, a connecting means or cushion is provided between the hammer housing and the upper end of the hammer.

In preferred embodiments, the connecting means is able to undergo elastic deformation, thereby storing potential energy when being held in a tensioned state. When the hammer is at the peak of its vertical movement, the connecting means is extended to a tensioned position. When the hammer is released, the potential energy stored in the connecting means in the form of tension is released and the hammer is accelerated toward the ground with greater energy than that provided by gravity alone.

U.S. Pat. No. 4,844,661 describes a drop hammer that utilises a reversing electromagnet to provide both lift and repulsion to the hammer. The electromagnet is engaged to raise the drop hammer to the top of its radius of movement. The electromagnet is then reversed and both gravity and the repulsion of the reversed electromagnet combine to accelerate the drop hammer to the ground, increasing the force with which it hits the ground.

It is a limitation however of such a system that the type of ground or material to be broken by the hammer is determined by the shape of the hammer and this cannot be easily varied. For the device to work with brittle materials when it is configured to work with ductile materials, a considerable amount of down time would be needed to fit a new hammer.

U.S. Pat. No. 5,248,001 describes a drop hammer that utilises a spring or springs within a drop hammer housing that are fully compressed when the hammer is at maximum vertical height before dropping. As the springs expand, the hammer is accelerated toward the ground again increasing the force at which the face of the hammer hits the region underneath.

It is a disadvantage of this system also that the type of material to be broken by the hammer is set by the shape of the end of the hammer and this cannot easily be varied. Accordingly, the hammer can only be used to break one type of material, be it brittle or ductile or the like, and a second machine would be needed on site for other materials.

The term tool end in accordance with the present invention should be understood to mean any tool fitted or formed at the longitudinal end of the hammer, wherein the shape of the tool end surface includes a substantially flat face, a blade, a convex or concave cup or a point, however, these are listed by way of example only. For ease of reference throughout the specification, the term 'face' will be used to refer to the condition of each end of the propelled rod, however, this should not be seen to be limiting in any way as a blade or point is not usually referred to has having a face, although they are intended to be included here when the term 'face' is used.

In preferred embodiments, the hammer with at least two tool ends is characterised in that the tool ends are of different configurations.

In further preferred embodiments, two tool ends of the hammer have different faces, one at either end of the hammer where one of the end faces of the hammer could be of a substantially flat, wide face in order to provide a large region of impact beneath the hammer, imparting the ability to weaken or break larger regions of brittle material.

In further preferred embodiments, the other end face on the alternate end of the hammer could be in the form of a blade, therefore allowing ductile or plastic material to be broken up.

It should be appreciated that the tip or end of the hammer could also be configured in other ways to be suitable for other types of material or demolition jobs. The tip could, for example, be in the shape of a spike or sharp tip, instead of a blade, although this is listed by way of example only and should not be seen to be limiting.

While drop hammers configured to cope with various types of materials do exist, there does not appear to be a single drop hammer device that allows many types of materials to be broken by the same piece of machinery without significant amounts of mechanical work or down time required to achieve this.

While it should be appreciated that some drop hammer devices could have the impact face at the end of the hammer removed in order to either renew the tip or face, or to alternate between a wide and narrow impact face, the amount of stress and strain placed on any nuts or bolts in that region would be immense. The likelihood of bolts or the like shearing through failure due to high impact loads would be greatly increased. This can be disadvantageous when there are deadline pressures or limited access to repair resources.

Another problem inherent with changeable tips is that a certain degree of expertise is required in order to ensure the new tip is correctly mounted in its seat and tension bolts having the appropriate tools to do so. Any misalignment of the new tip with the seat will result in rapid damage of the tip and loss of all precision of both the tip and seat mountings.

With regard to the present invention it should be appreciated that the nature of the material will determine the configuration of the hammer face. It is therefore envisaged that should a machine be needed for a job with several types of material, more that one double ended hammer could be supplied, as the hammer could be ejected and a whole new hammer put into the housing which has different faces.

The faces and ups of both the flat and bladed ends of the hammer could also be reinforced with material, or rebuilt due to wear down. It is an advantage of the present invention that the ability to remove the hammer from the hammer housing, reverse the direction of the hammer and reinsert it into the housing is a simple matter that could be undertaken by one person.

It should be appreciated that hammer will have certain projections that enable it to be lifted within the hammer housing to its peak vertical position. In order to reverse the orientation of the hammer, thereby exposing the alternate end of the hammer, those projections would need to be matched on the alternate side also.

In preferred embodiments, the additional projections would be positioned to the left or right of the original projection, on the same face.

However, it should be appreciated that the projections could be positioned on the alternate face, depending on the shape of the hammer housing, and the way in which the blade is reinserted into the housing on reversal.

Should the hammer be connected to a tensioned cable, that cable would need to be disconnected and then reconnected after re-orientation of the hammer, therefore also meaning that any connecting means would need to be matched on the alternate side of the hammer.

It should also be appreciated that as the hammer has varying end configurations, the means for raising the hammer would need to be positioned to any side of the hammer, not positioned at the end of it.

In preferred embodiments, the means for raising the hammer to its peak vertical position would be by a side chain and translation dog arrangement. The chain rotates around two sprockets positioned alongside the hammer. The chain has a translation dog that engages a projection positioned on the side of the hammer. As the chain is rotated, the hammer will lift as the projection affixed to the hammer rises with the rising of the translation dog. As the hammer reaches its maximum vertical lift height, the translation dog rotates around the chain sprocket and the hammer is released.

In further preferred embodiments, once the translation dog rotates around the sprocket and the hammer begins to fall, the rotation of the chain will mean the translation dog will come up against and engage the projection on the alternate side of the hammer, which is there in order to allow the direction of the hammer to be reversed. The translation dog will therefore impart a downward force to the hammer, increasing the acceleration of the hammer over a short distance due to the speed of rotation of the chain. Once the hammer picks up sufficient speed, gravity will increase the rate of decent of the hammer and the translation dog may no longer engage the projection.

According to another aspect of the present invention there is provided a drive mechanism for a drop hammer which includes a translation dog adapted to engage with at least two projections provided on a drop hammer to move said drop hammer, and a drive system associated with said translation dog, said drive system being adapted to move the translation dog, the drive mechanism characterised in that the translation dog is adapted to engage with a lifting projection provided on said drop hammer to translate the drop hammer in a first direction, and adapted to engage with a separate drive projection provided on said drop hammer to translate the drop hammer in a second direction opposing said first direction.

According to another aspect of the present invention there is provided a drop hammer which includes at least one lifting projection adapted to engage with a translation dog to translate the drop hammer in a first direction, and at least one drive projection adapted to engage with a translation dog to translate the drop hammer in a second direction opposing said first direction In preferred embodiments the drive system includes at least two sprockets, at least one endless chain and at least one translation dog.

In some embodiments, the hammer may be operated using the chain and translation dog drive down arrangement at an angle up to 120 degrees away from the vertical axis. In this case, the down stroke of the hammer becomes an upstroke and the effect of gravity is negative. Accordingly, the hammer and translation dog drive-down system become a drive-up system and essential for the hammer to function.

Throughout the specification the term 'first direction' may be associated with an upward movement of the hammer when the drop hammer devices is operated in a substantially vertical position. This should not be seen to be limiting however as in the case where the drop hammer device is operated at an angle above the horizontal, that first movement becomes a downward movement in effect, but the overall intention of the term should be interpreted as being the same.

Furthermore, the term 'second direction' may be associated with a downward movement of the hammer, or in a direction opposite to that of the first movement, although again, as above, this should not be seen to be limiting in any way.

Throughout the specification reference is also made to a 'chain' or 'drive system' however these terms are listed by way of example only and should not be seen to be limiting in any way as the means for moving the translation dog could be by a ram drive where the translation dog pivots up and down with the movement of the ram drive.

Furthermore, the term 'chain' is listed by way of example only and should not be seen to be limiting in any way as belt drive could also be used to move the translation dog around the sprockets.

In preferred embodiments the lift projection is a protrusion that is attached to the hammer, is configured to engage the translation dog and is positioned so as to be engaged by the translation dog as it moves past the lift projection. The translation dog will engage or abut the lift projection and cause the hammer to lift. When the translation dog rotates over the upper sprocket, the lift projection is released and the hammer will released in order to fall.

It should further be appreciated that the lift projection may be detachable and therefore replaceable as it wears.

In other preferred embodiments the drive projection is a protrusion that is also attached to the hammer on the alternate side to the lift projection in such a position SO as to be engaged by the translation dog as it moves past the drive projection on the downward stroke of the hammer. The translation dog will engage or abut the drive projection and cause the hammer to be driven in the direction desired, which is usually downward. The drive projection will be released when the speed of decent of the hammer increases beyond the speed of rotation of the chain.

In some embodiments when the drop hammer device is being operated in a position above horizontal, the translation dog may remain engaged with the drive projection until it rotates around the lower sprocket.

It should further be appreciated that the drive projection may be detachable and therefore replaceable as it wears.

In preferred embodiments there are two sprockets that associated with the drive system. Throughout the specification those sprockets are often referred to as upper and lower sprockets. It should however be appreciated that those terms are relative to the position of the hammer when in operation and as such, the term upper sprocket will refer to the sprocket at the upper end of the drop hammer device when it is being operated in a substantially vertical position. This will also apply to the term 'lower sprocket' as well and should however not be seen to be limiting in any way.

The translation dog may be fixed to the chain, and chain may rotate around the sprockets at speed. Accordingly, the translation dog can engage a lifting projection when the translation dog is moving. The lifting projection can be attached to the hammer and as such, the hammer will be moved in the direction that the translation dog is travelling and, when the hammer is being operated in a position below horizontal, the hammer will rise.

When the translation dog reaches the top sprocket and is rolled over same, the lifting projection is released. The hammer will continue to travel until the force of gravity stops the motion of the hammer and the hammer will then change direction.

It should be appreciated that at the moment when the translation dog engages the drive projection on the down stroke of the hammer, the hammer may be moving in an upward or, downward direction, or may even be stationary, depending on the speed of the chain, and accordingly, the speed of travel of the translation dog over the sprocket.

In some embodiments, if the speed of rotation of the chain were slower than the time taken for the hammer to reach its maximum height (where the downward force due to gravity is equal and opposite to the upward motion of the hammer), then the translation dog could engage the drive projection while the hammer were already beginning its downward motion.

It should therefore be appreciated that as the translation dog engages the drive projection, some stress and wear could be imparted to the chain, the surface of the translation dog engaging the projection and the projection itself. Furthermore, a knock or jolt may be noticeable as the translation dog engages the drive projection.

In other embodiments, if the speed of rotation of the chain were faster than the time taken for the hammer to reach its maximum height (when operated in a position below horizontal) then the translation dog would reengage the projection while the hammer was still moving in an upward direction.

It should be therefore appreciated that the upward motion of the hammer could be interrupted by the translation dog engaging the drive projection after rotating over the upper sprocket. Such an interruption of the upward motion of the hammer could place undue stress on the chain, the translation dog and the projection, causing increased deterioration of the drop hammer device.

In preferred embodiments, the speed of rotation of the chain with translation dog attached may be matched to length of time taken for the hammer to reach its peak movement and come to instantaneous rest before beginning to fall. The translation dog could then engage the drive projection as the hammer were beginning to gain momentum in the downward direction, and the engagement of the translation dog against the drive projection could be smooth in motion causing a minimum amount of wear to the translation dog, the chain and the drive projection.

It should be appreciated that same situation would occur, regardless of the orientation of the hammer away from use in a vertical position. Accordingly, while reference in the specification may be made to the hammer reaching its maximum height, one skilled in the art would recognise that this term should not be seen to be limiting. When the drop hammer device is operated near or above the horizontal, the hammer would reach a maximum distance away from the material to be broken.

Accordingly, an ideal location could be identified as to where to place the projection to be engaged by the translation dog on the downward stroke. If the chain were run at a constant high speed, being approximately 2.5 meters/second, the hammer would be released and want to continue its travel upwards by approximately another 300 mm due to momentum imparted by the lift speed. Before the hammer had stopped the upward motion, the translation dog would have already proceeded over the top of the upper sprocket and be on the way down, therefore engaging the projection on the hammer while the hammer were still travelling upward, and in some cases the hammer may have only travelled 100 mm of the 300 mm upward motion.

Such an engagement while the hammer was still in an upward motion could cause a high level of impact, potentially damaging the drop hammer device.

Accordingly, the speed of the sprocket can be slowed momentarily so that the translation dog's travel around the upper sprocket may be reduced from approximately 120 milliseconds to approximately 70 milliseconds at full speed. The slowing of speed of rotation of the chain may have the advantage of allowing the hammer to complete its upward motion and reach the point of zero motion before the translation dog engages the projection.

It should however be appreciated the slowing of the sprocket by momentarily reducing its speed of rotation is listed by way of example only and should not be seen to be limiting in any way. Other means of matching the position of the translation dog to the motion of the hammer may be utilized and such would be recognised by someone skilled in the art.

According to another aspect of the present invention there is provided a method of adjusting the speed of operation of a drive mechanism such as describe above, characterised by the steps of a) determining the position of a translation dog provided with said drive mechanism, and b) changing the speed of movement of the drive system when the translation dog is disengaged from a lift projection associated with a driven drop hammer.

In preferred embodiments the drive system is driven by a pressurised hydraulic fluid.

In further preferred embodiments the speed of the drive system is modified through changing the pressure of the hydraulic fluid used to drive same.

It should be appreciated that by adjusting the hydraulic flow to the sprocket drive, the sprocket will pause or slow in speed of rotation briefly, imparting a change in speed to the chain, thereby allowing the speed of the chain to be matched to the rise and fall of the hammer. This change in speed of the chain provides the ability to match the travel of the hammer to the drive down of the translation dog. Therefore, the hammer may be driven down from the highest point possible and thus maximum benefit from gravity may be gained for the remainder of the down stroke of the hammer when the hammer is used in a position below the horizontal line.

This is an advantage in that if the hammer is run at a higher rate, then the matching of the downward movement of the translation dog can be matched to the point of instantaneous zero movement of the hammer regardless of speed, allowing the drop hammer device to be optimally operated.

Furthermore, by optimising the timing of the downward movement of the translation dog to the instantaneous moment of the hammer, an increase of up to 100% in power may be achieved when using the same weight hammer and the same number of blows per minute.

Alternatively, if the blow per minute rate is increased by 100% and the weight of the hammer halved, the same power as a hammer not utilising a drive down chain, translation dog and projection combination may be achieved.

Additionally, when the drop hammer device is operated at low angles from the horizontal, or even at substantially horizontal, an increase in power of 40% may be achieved, in comparison with no power at all with a standard hammer device not utilising the drive down chain, translation dog and projection combination.

In further embodiments, a spring to arrest the movement of the hammer at the top of the stroke could also be utilized in the drop hammer device. The spring could make the moment of contact between the translation dog and the projection on the downward stroke of the hammer more reliable when the drop hammer device is operating at different angles or at varying stages of lubrication.

A hammer needs to be regularly greased in order to operate optimally. A reduction in grease causes a slowing of the blows per minute the hammer can achieve due to friction. A newly greased hammer will travel higher on the upward stroke when released from the translation dog than a dry hammer and as such, an inconsistency is introduced in the time taken for the hammer to slow down after being released from the translation dog.

In preferred embodiments, the introduction of a spring to the region above the maximum height of the hammer may help to arrest the upward motion of the hammer, once the hammer has been released from the translation dog, providing a consistency of operation regardless of the level of grease on the drop hammer device.

In other embodiments, when the hammer is being operated at a large angle from the vertical, particularly in a newly greased state, there is very little gravity to arrest the movement of the hammer after the translation dog releases it. Accordingly, the hammer will have enough force to potentially damage the upper end of the drop hammer casing, potentially even punching through the end of the drop hammer casing in a worst-case scenario. The introduction of a spring to the drop hammer device as described above may arrest the motion of the hammer and therefore avoid damage to the upper end of the drop hammer casing.

Accordingly, the combination of the chain, translation dog and projection with the spring may provide the ability for the drop hammer device to be utilised at high angles, even above the vertical. This is a distinct advantage over the prior art and allows entire buildings or the like to be broken up by one machine.

In other embodiments, the hammer housing can have a number of posts or uprights positioned near the exit point of the hammer from the housing that are cushioned. The cushioning would lessen the impact of the projection of the side hammer housing and potentially lengthen the lifetime of the hammer itself. The cushioning could be replaced over time as it wore out.

It should be appreciated that the hammer would be positioned at an appropriate height above the material or ground to be broken and as such, that ground would receive the majority of the impact force and not the projection or cushioning. Accordingly, the cushioning will wear out, but at any cushioning system would be designed for easy removal and replacement with little down time.

The advantage of having a drop hammer device with two differing faces that can be reversed with ease is that the same piece of equipment can be used on sites where varying types of material are required to be broken. This reduces the cost of a job requiring both brittle concrete and ductile asphalt or the like to be broken. It also enables the operator to switch easily between both types of impacting at short notice.

The ability of a drop hammer device to be applicable in varying situations is also an advantage in that the drop hammer device described herein does not return the impact vibration back to the excavator and therefore the operator. As the hammer is not physically connected to the housing, unless by the tensioned means alone, the impact of the hammer does not impart any vibration to the housing. Accordingly, the driver is not exposed to high levels of vibration and therefore the job becomes more tolerable over extended periods of time. Additionally, the driver does not welcome a break when differing types of material are revealed and needed to be broken and a new machine required. Instead, the comfort to the operator is high, and the damage to the excavator itself from extensive vibration is non-existent.

A further advantage of a drop hammer device that includes a drive down means is that the pressure of impact can be increased substantially, allowing the same machine to increase its workload. Additionally, if the weight of the hammer is halved, the speed of impacting can be increased while maintaining the same impact pressure. This also provides an improvement over the prior art and would allow a single machine to increase work capacity or type of material applicable for impact by a drop hammer device.

Furthermore, the addition of the drive down means is that the drop hammer can be operated at angles away from substantially vertical. The drop hammer may even be used at angles up to 120 degrees away from the vertical, meaning that the hammer is operating not as a drop hammer but as a drive hammer, allowing one machine to do the job of both a drop hammer device and a jack hammer or the like.

A further advantage of the present invention is that the ability to change the speed of the rotation of the chain to allow the translation dog to engage the drive projection is the ideal position is that wear of the drop hammer device is minimised and the smoothness of operation is maximised, allowing an operator to handle longer working times with full concentration.

Furthermore, variance in use of the hammer brought about by greasing of the hammer is minimised by inclusion of the spring. Variations in operation are also minimised, reducing wear and variation in responsiveness of the drop hammer device, allowing for a more consistent operation of the device.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
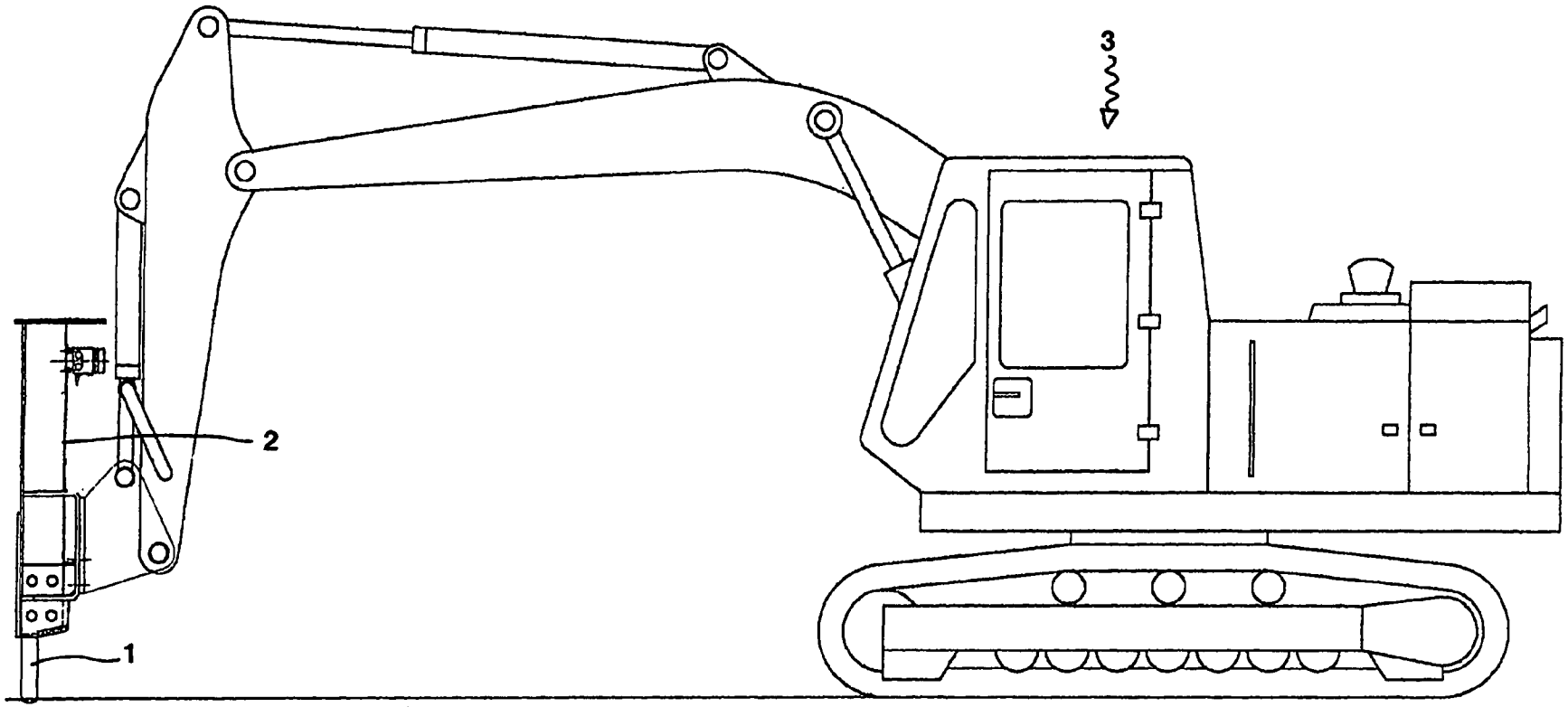
FIG. 1 is a diagrammatic illustration of a preferred embodiment of the present invention; a FIG. 2 is a diagrammatic representation of a preferred embodiment of the present invention showing the side on view of the drop hammer with lifting means.

With reference to FIG. 1, there is illustrated a drop hammer (1), encased within a hammer housing (2) which is attached to a hydraulic excavator generally indicated by arrow 3.

Figure 2:
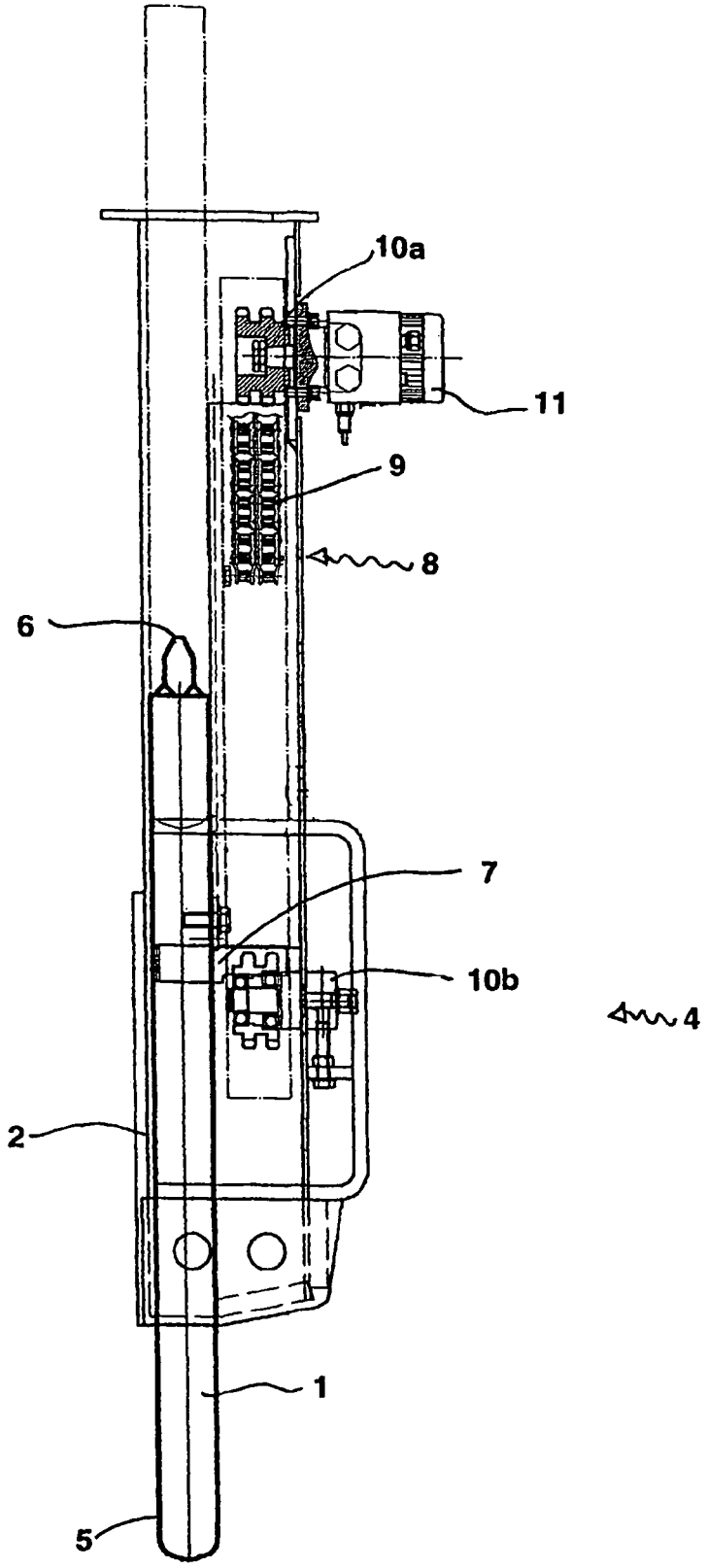

With respect to FIG. 2 there is shown a close-up of a drop hammer device generally indicated by arrow 4. The drop hammer device (4) consists of a hammer (1) with a dull end (5) and a sharp end (6), a projection (7), a raising mechanism generally indicated by arrow 8, the raising mechanism in the form of a rotating chain (9), with two cogs (10*a* and *b*), a hydraulic activating means (11) and a hammer housing (2).

Figure 3:
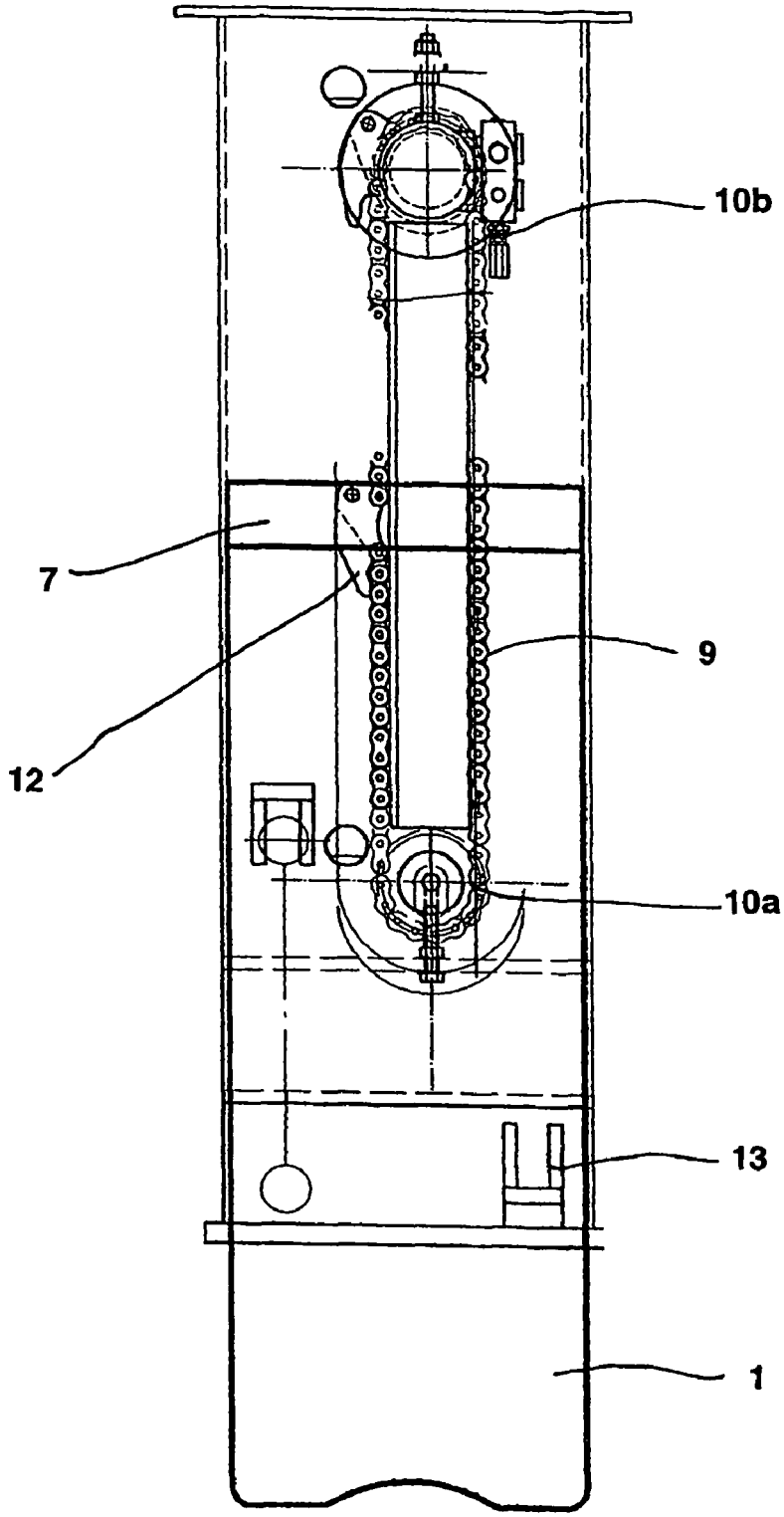
FIG. 3 is a close-up diagrammatic representation of a side view of the drop hammer showing the cushioning means and rotating chain.

With respect to FIG. 3 there is shown a side view of the hammer (1) with the rotating chain (9), the two end sprockets (10*a* and *b*) which the chain (9) rotates around, a translation dog (12) which engages the projection (7) on the hammer (1). Also shown if FIG. 3 is the cushioning means (13) that the hammer (1) can rest against when situated in its lowest vertical position.

When the drop hammer (1) is operating, the rotating chain (8) with translation dog (12) rotates.

The translation dog (12) engages the projection (7) situated on the side of the hammer perpendicular to the rotating chain (9).

As the chain (9) rotates, the translation dog (12) rises, lifting the projection (7) which in turn raises the hammer (1).

When the projection (7) rises to a point level with the upper sprocket (10*a*), the translation dog (12) rotates over the top of the upper sprocket (10*a*) and releases the projection (7), allowing the hammer to fall.

When the hammer (1) has completed its fall, the translation dog (12) positioned on the rotating chain (9) will then engage the projection (7) and repeat the vertical lift.

Also shown in FIG. 3 is the cushioning means (13) that the hammer (1) can rest against when situated in its lowest vertical position. If the hammer (1) is not in use, the projection (7) will rest against the cushioning means (13) so that the hammer can either be moved or transported without banging against the hammer housing, or damaging the rotating chain or the like.

Not shown is the tensioned means that can be attached to a point just below the upper end of the drop hammer (1). As the hammer (1) rises to its upper vertical limit, the tensioned means is stretched. When the translation dog (12) is rotated and the projection (7) released, the hammer (1) is pulled in a downward direction, accelerating the hammer (1) into the ground due to the release of the tensioned means.

Aspects of the present invention have been described by way of example only and it should be appreciated that modifications and additions may be made thereto without departing from the scope thereof.

The invention claimed is:

1. A hammer assembly, including:

a housing with at least one opening;

a hammer formed as a substantially elongated unitary weight formed with integral first and second tool ends located at opposing longitudinal distal ends of the weight, said hammer including at least two protrusions, said hammer received in the housing in a first orientation; and a drive mechanism including a dog attached to a loop of chain extending about at least two sprockets, at least one sprocket being connected to a motor and rotatable to drive said chain and attached dog, the dog engaging with said protrusions on the hammer during said rotation to reciprocate the hammer by driving the hammer in, a first direction away from an external working surface, and an opposing second direction toward the working surface, said tool striking the working surface through said housing opening, wherein the hammer is capable of being removed from the housing and re-inserted in the housing in a second orientation with said first and second tool ends being reversed.

2. The hammer assembly as claimed in claim 1, wherein the hammer includes at least two protrusions located on a common lateral hammer face, said drive mechanism configured to engage one said protrusion when driving the hammer in the first direction and engage with the other protrusion when driving the hammer in the second direction.

3. The hammer assembly as claimed in claim 2, wherein the hammer includes at least two protrusions on each of two opposing lateral hammer faces.

4. The hammer assembly as claimed in claim 2, further including a cushion fixed to the housing for engaging one of the protrusions.

5. The hammer assembly as claimed in claim 1, wherein the housing is configured for attachment to an articulated arm of an excavator or other machine and the drive mechanism is enclosed within the housing.

6. The hammer assembly as claimed in claim 1, wherein the hammer is multifaceted.

7. The hammer assembly as claimed in claim 1, wherein the opposing hammer tool ends are non-identical.

8. The hammer assembly as claimed in claim 1, wherein the tool ends are configured as a substantially flat surface, a blade, a substantially convex surface, substantially concave surface, or a spike.

9. The hammer assembly as claimed in claim 1, wherein said rotation of the sprockets, dog and chain is substantially parallel to the hammer.

10. The hammer assembly as claimed in claim 1, further including a connecting apparatus between the hammer and the hammer housing.

11. The hammer assembly as claimed in claim 10, wherein the connecting apparatus is capable of elastic deformation.

12. The hammer assembly as claimed in claim 10, wherein the connecting apparatus is detachable.

13. A hammer assembly, including: a housing with at least one opening; a hammer formed as a substantially elongated unitary weight formed with integral first and second tool ends located at opposing longitudinal distal ends of the weight, said hammer including at least two protrusions, said hammer received in the housing in a first orientation; and a drive mechanism including a dog attached to a loop of chain extending about at least two sprockets, at least one sprocket being connected to a motor and rotatable to drive said chain and attached dog, the dog engaging with said protrusions on the hammer during said rotation operable to reciprocate the hammer by driving the hammer in, a first direction away from an external working surface, and an opposing second direction toward the working surface, said tool striking the working surface through said housing opening, wherein the hammer is capable of being removed from the housing and re-inserted in the housing in a second orientation with said first and second tool ends being reversed; wherein said hammer is received in the housing in said first orientation, said method characterised by the steps of: withdrawing the hammer from the housing, and reinserting the hammer in said second orientation.

* * * * *